US006945805B1

(12) United States Patent
Bollinger

(10) Patent No.: US 6,945,805 B1
(45) Date of Patent: Sep. 20, 2005

(54) SELF-LOCKING ROTATABLE ELECTRICAL COUPLING

(76) Inventor: Lester Bollinger, P.O. Box 532, Dumas, TX (US) 79029

( * ) Notice: Subject to any disclaimer, the term of this patent is extended or adjusted under 35 U.S.C. 154(b) by 0 days.

(21) Appl. No.: 10/978,810

(22) Filed: Nov. 2, 2004

(51) Int. Cl.[7] ..... H01R 4/50
(52) U.S. Cl. ..... 439/348; 439/352
(58) Field of Search ..... 439/348, 347, 439/352, 312, 345, 108

(56) References Cited

U.S. PATENT DOCUMENTS 3,599,167 A * 8/1971 Adrian ..... 439/348
3,963,291 A 6/1976 Maloof
4,583,798 A 4/1986 Blazowich
4,758,177 A * 7/1988 Herron ..... 439/348
4,875,874 A 10/1989 Windsor, Jr.
5,108,301 A 4/1992 Torok
5,129,836 A 7/1992 Ursich
5,197,897 A 3/1993 Torok
5,277,590 A 1/1994 Thomas et al.
5,393,239 A 2/1995 Ursich
5,551,884 A 9/1996 Burkhart, Sr.
5,934,911 A * 8/1999 Stout et al. ..... 439/21
5,984,687 A 11/1999 Schwarz
5,984,709 A * 11/1999 Zink et al. ..... 439/348
6,022,237 A * 2/2000 Esh ..... 439/348
6,171,129 B1 1/2001 Phillips

* cited by examiner

*Primary Examiner*—Hien Vu
(74) *Attorney, Agent, or Firm*—Norman B. Rainer

(57) ABSTRACT

A self-locking electrical coupling includes slidably interactive male and female components having interactive contacts that produce continuity for two polarized power lines and a ground wire line, and maintain said continuity during rotative movement between the components. The male component has a cylindrical post equipped with a centered and an off-centered metal prong and a surrounding sleeve having a forwardly directed conductive circular rim. The female component has a socket equipped with a center contact adapted to abut with the centered prong, a ring-shaped contact adapted to abut with the off-centered prong, and a third contact disposed radially outward from the ring-shaped contact and adapted to abut with the conductive circular rim.

8 Claims, 3 Drawing Sheets

SELF-LOCKING ROTATABLE ELECTRICAL COUPLING

BACKGROUND OF THE INVENTION

1. Field of the Invention

The present invention relates to electrical connectors for power cords and the like. More particularly, the present invention relates to rotatable connectors comprised of self-locking male and female components.

2. Description of the Prior Art

Electrical power cords are used in many different applications to conduct electricity from a power source to an electrically powered apparatus. Power cords are used in connection with all types of electronic equipment such as stereos, computers, portable electric appliances such as those typically found in a kitchen, hand-held power tools and the like. Power cords can be formed having virtually any length, from one foot or less to hundreds of feet. Those longer cords, often referred to as extension cords, allow an apparatus connected to the cord to be more portable, as the use of the device will not be restricted by or limited to the location of the power source. Thus, it will be appreciated that power cords serve a number of useful functions in connection with many different types of devices.

One significant drawback associated with power cords is that such cords often tend to twist or become knotted during use. This problem is especially prevalent in connection with equipment that is continuously moved around relative to the power source, such as typical hand-held power tools. A tangled or twisted cord results in a reduction of the effective length of the power cord, which limits the useful range of the tool coupled to the power cord. This requires that the user manually untangle the cord, which is inconvenient, annoying, and time-consuming.

In addition, continual twisting or knotting of a cord can cause stress or strain on the cord. The conductors housed inside the cord may become crimped or may even break, resulting in a shortened useful life of the power cord.

A number of swivel connector designs have been proposed by others in an attempt to overcome the above-described disadvantages. One of those prior art devices includes a plurality of bearings and interposed insulating washers in a housing. A form of that device is disclosed in U.S. Pat. No. 1,649,276 to Adam. The bearings include inner and outer races connected to electric leads from a pair of severed power cord segments. The ends of the electric leads are sandwiched between the inner races and the adjacent insulating washers to effect an electrical connection with the inner races. It will be appreciated that any relative displacement of the bearings and washers will likely create a short circuit, as the electric leads are not securely connected to those races.

Another rotatable, multiple lead connector found in the prior art includes a receptacle with a conically shaped internal bore to receive a generally frusto-conically shaped plug. A form of this device is disclosed in U.S. Pat. No. 3,193,636 to Daniels. The receptacle includes a plurality of radially inwardly projecting V-shaped conductive contacts at axially and circumferentially spaced apart locations. Outwardly projecting, conductive contact rings with V-shaped grooves are formed on the periphery of the plug to engage the contacts and make electrical contact while allowing the plug to be rotated relative to the receptacle as the V-shaped tips ride in the V-shaped grooves. Such a device requires a rather elaborate and detailed construction.

Yet another prior art swivel device includes male and female connectors formed with complementary concave and convex circumferential regions to establish electrical contact and to provide for relative rotation. A form of this device is disclosed in U.S. Pat. No. 5,409,403 to Falossi et. al. The concave and convex sections are conductive and electrically connected to electric wires from a pair of power cord segments. Use of this device results in relative rotation between the electrical contacts which over time may cause a wearing down of the contact surfaces and thus an open circuit.

Therefore, it appears that there continues to be a need for a rotatable electrical connector which is relatively simple to construct and which provides dependable electrical connections while permitting free rotation. The present invention addresses these needs.

Inadvertent removal of an electrical plug from a socket or other receptacle that supplies electrical power has been a matter of concern since electrical appliances became common. Almost everyone who has ever used a hand mixer, vacuum cleaner, power tool, or other hand-manipulated electrical appliance has accidentally pulled the plug out of its interactive receptacle. At best, such interruptions are annoying and inconvenient for the user, who has to stop work to re-insert the plug before he can continue. In some situations, replacing the plug significantly disrupts work in progress, as when a construction worker has to climb down a ladder to replace the plug, then climb back up to resume work. Over time, repeated stress on the plug may damage the conductors to the point that the power cord must be replaced. In some situations, damaged plugs and loose connections can lead to potentially dangerous sparking and electrical shorts.

A wide variety of locking electrical adapters and connectors, for wall outlets, plugs, sockets, extension cords and the like, have been developed in response to these concerns. Many of these devices have slidable actuators and/or locking blocks for securing the prongs of an electrical plug into a wall outlet. Burkhart, Sr. provides such a device, which has a lockable, spring-loaded socket with a pair of hinged jaws for retaining an electrical plug in place (U.S. Pat. No. 5,551,884). The plug can be released from the socket by simply pushing it inwards, then allowing it to be thrust out under spring pressure.

In U.S. Pat. No. 5,108,301, Torok discloses a locking cord connector that includes a non-conductive housing, a pair of conductors each having a male and female electrical contact (each with leaf-type springs), two spring-loaded locking mechanisms with slide blocks, and a slidable actuator. The first locking mechanism locks the male electrical contacts to a receptacle; the second locks the female contacts to another plug (such as a conventional plug of an electrical appliance). Long shows a socket with a releasable locking mechanism (U.S. Pat. No. 4,909,749). His device includes a housing that contains transversely spaced contact bars and a cam-operated clamp that locks the contact bars and the prongs of a plug together to deter removal.

Borges discloses a self-locking electrical connector consisting of a male plug and a female receptacle (U.S. Pat. No. 4,867,697). The receptacle includes a self-locking mechanism with a spring-loaded locking block which automatically locks the two parts together after insertion of the prongs of the male plug.

Strand's connector, described in U.S. Pat. No. 4,700,997, is designed for attaching a flat electrode (such as an EEG electrode) to a cable. The connector includes resilient upper and lower jaws that are joined at their respective rear ends by a flexible, resilient spring, and a slidable actuator that compresses the jaws together to hold a flat electrode in place.

Hong's device (U.S. Pat. No. 4,627,681) includes a movable wedge for pressing the male and female contacts together, whereas Imhoff's plug (U.S. Pat. No. 4,544,216) has a locking ground prong with a longitudinal "V"-shaped or "U"-shaped recess that holds a slidable, spring-loaded locking member. Warner, et. al. provide a locking electric receptacle that includes a push-button rod and toggle mechanism for frictionally engaging the prongs of a male plug (U.S. Pat. No. 3,710,304).

Mangold (U.S. Pat. No. 2,435,586) and Cornwell (U.S. Pat. No. 2,261,615) provide plugs that can be laterally expanded upon insertion into a socket in order to maintain good electrical contact. Both devices include slide actuators for moving the elements that expand the prongs. Osborn's connector has a coupler with two notched tongues, teeth shaped to engage the tongues, and a transverse slidable actuator for locking it into position (U.S. Pat. No. 1,536,688).

Torok (U.S. Pat. No. 5,197,897) discloses a mechanism which is self-locking and also rotatable. His device has a non-conductive housing, a pair of conductors, two spring-loaded locking mechanisms with slide blocks, and a slidable actuator. One of the locking mechanisms locks the male electrical contacts to a receptacle; the other locks the female contacts to another plug.

Other designs include Garrison's three-prong plug with a hollow, locking ground prong (U.S. Pat. No. 5,480,318). A spring-loaded catch that engages the front wall of a socket or wall outlet is attached to the prong. The catch can be released by pushing the spring in with a nonconducting rod. Dynia's locking connector (U.S. Pat. No. 5,427,543) includes two "U"-shaped connectors for receiving the prongs of an electrical plug. A sliding cam assembly activates a spring-loaded pin to compress the sides of the connectors and retain the prongs in place. Ursich provides a self-locking female electrical socket with an automatic release mechanism and two balls that engage the holes in the prongs to secure them in place (U.S. Pat. Nos. 5,393,239 and 5,129,836). The actuator consists of a shaft with a cut-out area that permits the user to engage/disengage the balls mounted in the body of the device.

Notwithstanding the wide variety of designs encompassed by the prior art, many presently-available locking connectors and adapters are relatively complex, correspondingly difficult and expensive to manufacture, and too delicate and breakage-prone for long-term household or industrial use. Some locking connectors require special tools to disengage and remove a locked plug, and many cannot accommodate a third, ground wire conductor or polarized prongs of the male component.

There is a continuing need for locking electrical adapters and connectors which can be used to releasably secure a plug to a conventional extension cord socket, or the like. Such devices should be simple and easy to manufacture, easy to use, and enhance the safe and uninterrupted use of electrical appliances and tools that frequently require the dragging or hanging of portions of the power cord (or extension cord) during use.

It is accordingly an object of the present invention to provide a coupling for electrical cables, said coupling comprised of male and female components that are self-locking and permit rotation axially with respect to said cables.

It is another object of this invention to provide a coupling as in the foregoing objective wherein said cables include two power conductors and a third, ground conductor line, and said coupling automatically achieves continuity of all three of said lines.

It is a further object of the present invention to provide a coupling of the aforesaid nature wherein said two power conductor lines are polarized, and said coupling automatically preserves the polarity of the interconnected power conductor lines.

It is a still further object of this invention to provide a coupling of the aforesaid nature of simple, rugged design amenable to low cost manufacture.

These objects and other objects and advantages of the invention will be apparent from the following description.

SUMMARY OF THE INVENTION

The above and other beneficial objects and advantages are accomplished in accordance with the present invention by a self-locking rotatable electrical coupling device comprised of male and female components, each having a mating front extremity and rearwardly opposed infeed extremity that receives a cable having two polarized power conductor lines and a third ground wire line, and a spring-activated locking mechanism that interactively secures said components at their mating extremities, said male component comprised of:

a) a base structure fabricated of electrically non-conductive material, and b) a cylindrical post emergent from said base structure at said mating extremity and terminating in a distal extremity having forwardly directed centered and off-center metal prongs that communicate with said power conductor lines, a sleeve that surrounds said prongs and terminates in a forwardly directed circular conductive rim that communicates with said ground wire line, and a recessed annular groove adapted to interact with said locking mechanism, said female component comprised of:

a) a base structure fabricated of electrically non-conductive material, and b) a socket of cylindrical contour adapted to snugly secure said post and having a bottom equipped with a center contact which, upon insertion of said post into said socket abuts against said centered prong, a ring-shaped contact disposed about said center contact and adapted to abut against said off-centered prong, and a third contact disposed radially outward from said ring-shaped contact and adapted to abut against said conductive rim, said locking mechanism comprised of:

retainer means adapted to be reversibly forced to intrude radially into said socket, and a spring-biased collar slidably mounted exteriorly of said socket and urged axially forward in a manner to cause intrusive movement of said retainer means, whereby:

when said post is manually pushed into said socket, said retainer means engage said annular groove, to produce a connected state wherein electrical continuity is established across said male and female components for the polarized power lines and ground line, and such continuity is unaffected by axial rotation of either component, and release of said engagement to a disconnected state is achieved by pulling said collar rearwardly against said spring-biasing.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
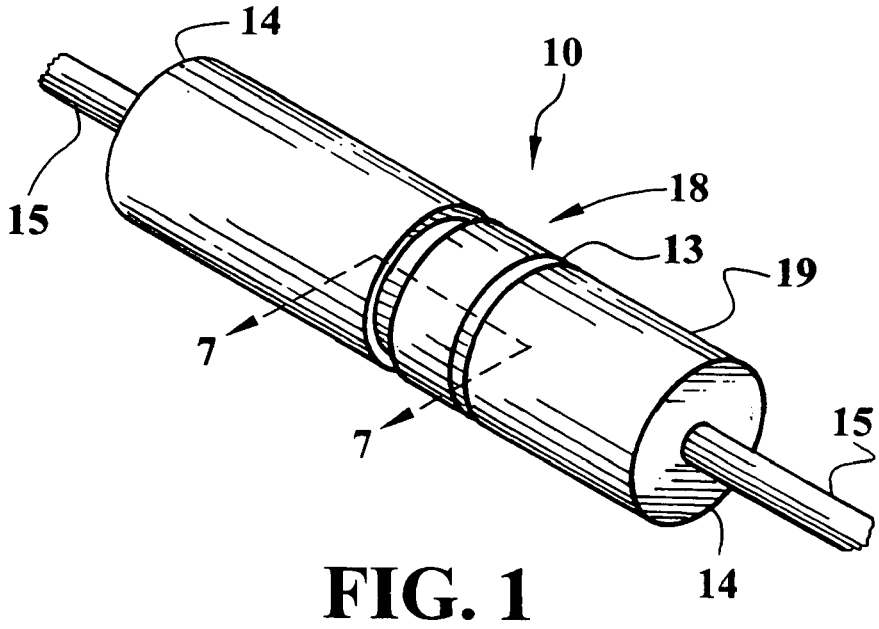
FIG. 1 is a perspective view of the coupling device of this invention shown in its connected state.
Figure 2:
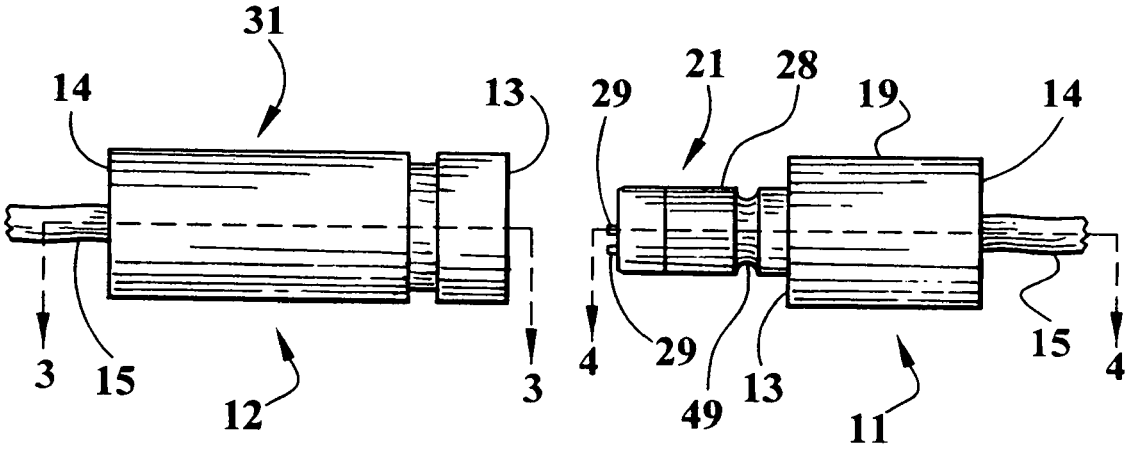
FIG. 2 is a side view showing the device in its disconnected state.
Figure 3:
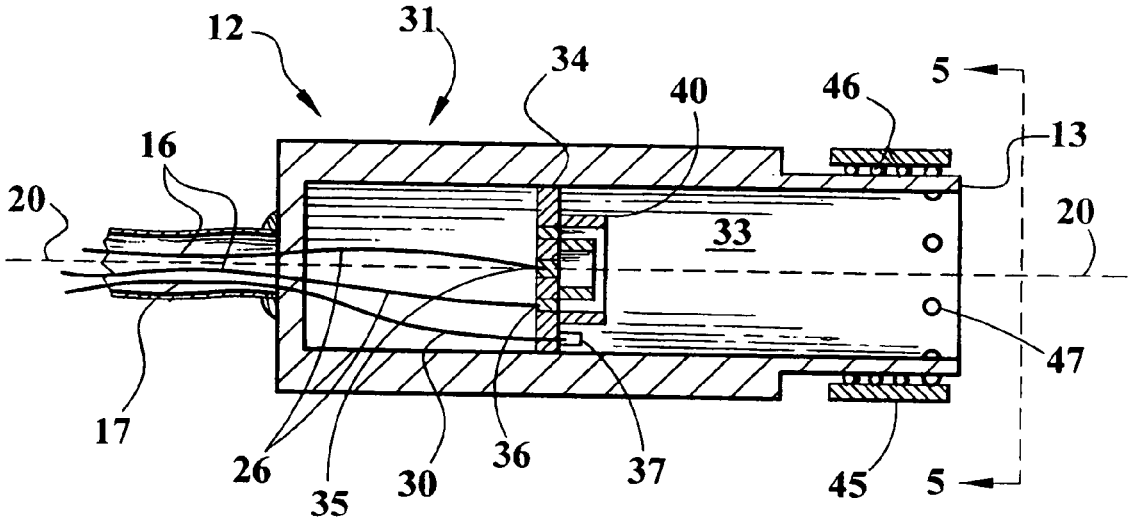
FIG. 3 is an enlarged sectional longitudinal view taken in the direction of the arrows upon the line 3—3 of FIG. 2.
Figure 4:
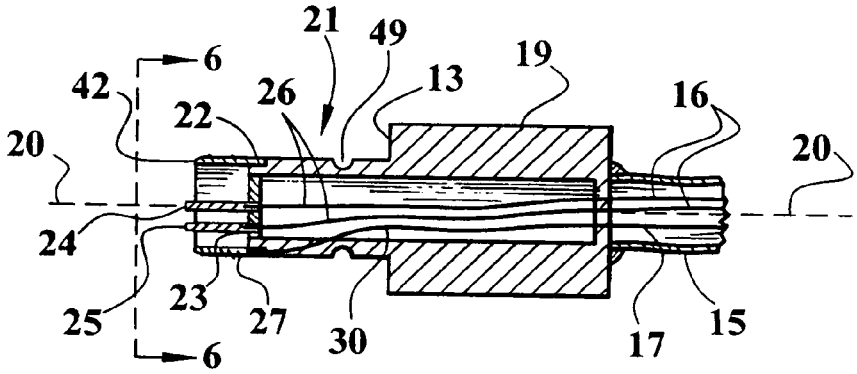
FIG. 4 is an enlarged sectional longitudinal view taken in the direction of the arrows upon the line 4—4 of FIG. 2.
Figure 5:
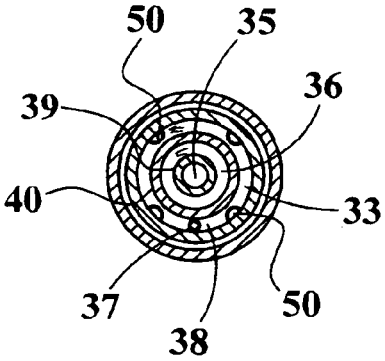
FIG. 5 is an end view taken in the direction of the arrows upon the line 5—5 of FIG. 3.
Figure 6:
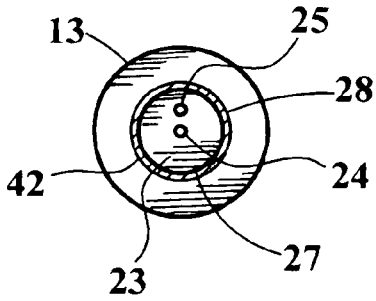
FIG. 6 is an end view taken in the direction of the arrows upon the line 6—6 of FIG. 4.
Figure 7:
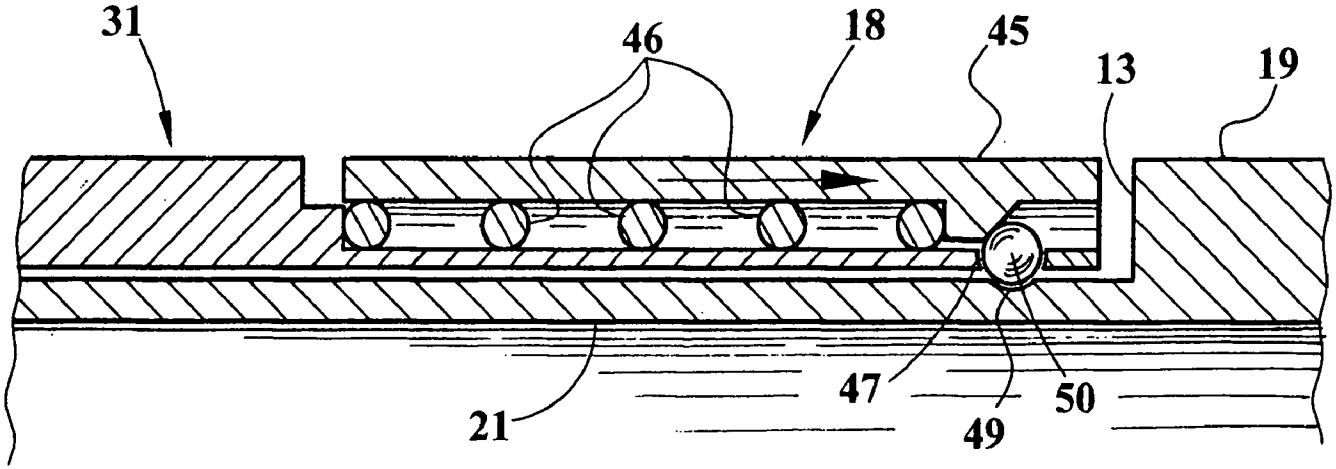
FIG. 7 is an enlarged fragmentary sectional view taken in the direction of the arrows upon the line 7—7 of FIG. 1, and showing the device in its coupled state.
Figure 8:
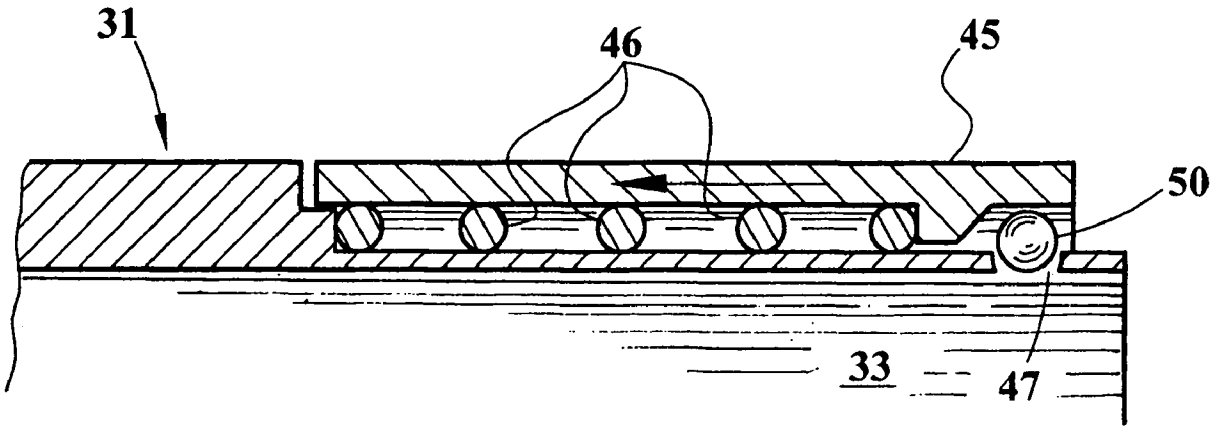
FIG. 8 is a view similar to FIG. 7 showing the device in its uncoupled state.

Referring now to FIGS. 1–8, an embodiment of the coupling device 10 of the present invention is shown comprised of male and female components 11 and 12, respectively, each having a mating front extremity 13 and rearwardly opposed infeed extremity 14. Electric cables 15 that contain two polarized power conductor lines 16 and a third, ground wire line 17 enter said rear infeed extremities 14. A spring-activated locking mechanism 18 interactively connects said components at their mating extremities 13, as shown in FIG. 1.

Said male component is comprised of a base structure 19 fabricated of an electrically non-conductive material such as a moldable plastic. The exemplified base structure is shown having a circular cylindrical shape elongated upon center axis 20. Alternative shapes may, however, be employed. A cylindrical coupling post 21 is emergent from said base structure at mating extremity 13, preferably as a continuous integral extension of base structure 19. Post 21 terminates in a distal extremity 22 having an end cap 23 that secures forwardly directed axially centered contact prong 24 and forwardly directed off-center contact prong 25. Said prongs are connected to power conductor lines 16 by way of internal conductor wires 26. The expression "prong", as employed herein is intended to include any elongated rigid narrow electrically conductive structure.

A cylindrical sleeve 27 is attached to distal extremity 22 in a manner to be smoothly continuous with the exterior surface 28 of post 21. Sleeve 27 surrounds said prongs and extends forwardly a distance substantially equal to the length of said prongs. Sleeve 27 terminates in a forwardly directed circular electrically conductive rim 42. In some embodiments, sleeve 27 may be fabricated entirely of metal. In alternative embodiments, sleeve 27 may be of plastic construction equipped with an inserted conductive metal rim. Electrical connectivity between rim 42 and ground wire line 17 is established by way of internal conductor wire 30. An annular retaining groove 49 is recessed into post 21 adjacent front extremity 13.

Female component 12 is comprised of base structure 31 fabricated of an electrically non-conductive material such as a moldable plastic. The exemplified base structure is shown having a circular cylindrical shape elongated upon center axis 20. Alternative shapes may be employed, but it is preferable that base structures 31 and 19 have similar or identical outer configurations. A socket 33 of cylindrical contour and dimensioned to snugly receive post 21 opens upon mating extremity 13 in centered relationship with axis 20. Socket 33 has a bottom panel 34 that insulatively secures a center metal contact 35 and ring-shaped metal contact 36 disposed around contact 35. Center contact 35 is positioned so as to abut against the tip 29 of prong 24 when post 21 is fully inserted into socket 33, and contact 36 is disposed to abut with tip 29 of prong 25. Said contacts 35 and 36 are substantially flat and orthogonally disposed to axis 20. An outer contact in the form of post 37 is positioned in peripheral annular region 38 and adapted to contact the circular rim 42 of sleeve 27. Said contacts 35, 36 and 37 are secured by and electrically insulated from each other by way of panel 34.

Center contact 35 and ring-shaped contact 36 are connected to power conductor lines 16 by way of internal conductor wires 26. Contact post 37 is connected to ground wire line 17 by way of internal conductor wire 30. Concentric cylindrical isolating collars 39 and 40 may be disposed about center contact 35 and ring-shaped contact 36, respectively. Said collars may be integral with bottom panel 34, and extend forwardly therefrom to lengths of ⅛ to ⅜ inch.

By virtue of the aforesaid manner of construction, it should be noted that, when coupling post 21 is fully into socket 33, electrical continuity is established between the power lines and ground wire lines of the male and female components. Such contact or electrical continuity is maintained even when said components are rotated about center axis 20. The several electrical contacts of the male and female components may be spring-urged forwardly, namely toward interactive engagement with the matching contact of the opposite component. Such arrangement promotes more assured interaction of the several contacts.

An embodiment of locking mechanism 18 is shown having a manipulating collar 45 slidably disposed upon a forward portion of base structure 31 that terminates at front extremity 13. A coil spring 46, positioned between collar 45 and said base structure, urges said collar 45 forwardly. A series of detent balls 50 are seated within holes 47 that permit partial intrusion of said balls into socket 33. When coupling post 21 is fully inserted into socket 33, balls 50 partially enter retaining groove 49. Such action locks the two components together in a manner which prevents inadvertent separation. When it is desired to separate the two components, collar 45 is manually pulled rearwardly to a position which enables the balls 50 to rise out of groove 49. Alternative spring-urged locking mechanisms may, however, be employed. For example, balls 50 may be replaced by arms of metal or plastic construction.

The configuration and operation of the coupling device of this invention, as herein described, therefore provides for the self-locking interaction of the male and female components to provide a rotatable coupling that establishes electrical continuity of polarized power lines and a ground wire line.

In one aspect of the present invention, the male component of the coupling is incorporated into the handle of a power tool. This permits omission of the power cord generally attached to the power tool, thereby permitting easier storage. Also, the male component, if integrated into the tool, may be employed to facilitate storage of the tool. For example, the cylindrical coupling post 21 may be caused to seat vertically into a properly sized circular aperture in a workbench shelf.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A self-locking rotatable electrical coupling device comprised of male and female components, each having a mating front extremity and rearwardly opposed infeed extremity that receives a cable having two polarized power conductor lines and a ground wire line, and a spring-activated locking mechanism that interactively secures said components at their mating extremities, said male component comprised of:

a) a base structure fabricated of electrically non-conductive material, and b) a cylindrical post emergent from said base structure at said mating extremity and terminating in a distal extremity having forwardly directed centered and off-center metal prongs that communicate with said power conductor lines, a metal sleeve that surrounds said prongs and terminates in a forwardly directed conductive circular rim that communicates with said ground wire line, and a recessed annular groove adapted to interact with said locking mechanism, said female component comprised of:

a) a base structure fabricated of electrically non-conductive material, and b) a socket of cylindrical contour adapted to snugly secure said post and having a bottom equipped with a center contact which, upon insertion of said post into said socket abuts against said centered prong, a ring-shaped contact disposed about said center contact and insulatively separated therefrom and adapted to abut against said off-centered prong, and a third contact disposed radially outward from said ring-shaped contact and insulatively separated therefrom and adapted to abut against said conductive circular rim, wherein said locking mechanism is comprised of:

retainer means adapted to be reversibly forced to intrude radially into said socket, and a spring-biased collar slidably mounted exteriorly of said socket and urged axially forward in a manner to cause intrusive movement of said retainer means, whereby:

when said post is manually pushed into said socket, said retainer means engage said annular groove to produce a connected state wherein electrical continuity is established across said male and female components for the polarized power lines and ground line, and such continuity is unaffected by axial rotation of either component, and release of said engagement to a disconnected state is achieved by pulling said collar rearwardly against said spring-biasing, and wherein said spring-biased collar, said male and female components have identical outer configuration.

2. The coupling device of claim 1 wherein said retainer means are balls.

3. The coupling device of claim 1 wherein said male component is fixedly associated with a power tool.

4. The coupling device of claim 1 wherein said configuration is circular cylindrical.

5. The coupling device of claim 1 wherein said cylindrical post is a continuous integral extension of said base structure.

6. The coupling device of claim 1 wherein said metal sleeve is smoothly continuous with the outer surface of said cylindrical post.

7. The coupling device of claim 1 further comprised of isolating collars forwardly emergent from the bottom of said socket and disposed about said center and ring-shaped contacts.

8. The coupling device of claim 6 wherein said sleeve is of all metal construction.

* * * * *